United States Patent [19]

Salemi et al.

[11] 4,069,127

[45] Jan. 17, 1978

[54] METHOD AND APPARATUS FOR RECOVERY OF METAL FROM LIQUID

[75] Inventors: Jerry S. Salemi, Kildeer; Paul Dean Pease, Palatine, both of Ill.

[73] Assignee: Ecological Systems, Inc., Palatine, Ill.

[21] Appl. No.: 655,004

[22] Filed: Feb. 4, 1976

[51] Int. Cl.[2] ..... C25C 1/20; C25C 7/00

[52] U.S. Cl. ..... 204/229; 204/109; 204/228; 204/237; 204/271; 204/272; 204/273; 204/275

[58] Field of Search ..... 204/109, 218, 223, 229, 204/237, 228, 269, 270, 272, 273, 275, 271, 278, 294, 234

[56] References Cited

U.S. PATENT DOCUMENTS

| | | | |
|---|---|---|---|
| 686,395 | 11/1901 | Dessolle | 204/275 X |
| 780,191 | 1/1905 | Johnson | 204/275 X |
| 818,174 | 4/1906 | Holland | 204/275 X |
| 902,892 | 11/1908 | Lutz | 204/228 X |
| 991,685 | 5/1911 | Aldrich et al. | 204/269 X |
| 1,148,798 | 8/1915 | Pyne et al. | 204/269 X |
| 1,467,202 | 9/1923 | Slatineanu | 204/234 X |
| 1,712,284 | 5/1929 | Turnock | 204/228 |
| 2,158,410 | 5/1939 | Doran | 204/234 X |
| 2,766,202 | 10/1956 | Estes | 204/270 X |
| 2,997,438 | 8/1961 | James et al. | 204/273 |
| 3,397,087 | 8/1968 | Yoshizawa et al. | 204/294 X |
| 3,619,286 | 11/1971 | Gutnajer | 204/294 X |
| 3,702,814 | 11/1972 | Mandroian | 204/273 X |
| 3,715,291 | 2/1973 | Bentley | 204/275 X |

*Primary Examiner*—Arthur C. Prescott
*Attorney, Agent, or Firm*—Anthony S. Zummer

[57] ABSTRACT

A method and apparatus for removing a metal from a liquid solution is herein disclosed. The apparatus includes a receiving tank. A circulating tank is connected to the receiving tank. A circulating pump is connected to the circulating tank. A circulating tank drain pump is connected to the circulating tank. A recovery tank is connected to the circulating tank and the circulating pump. The recovery tank has an anode and a cathode positioned therein. A source of electric current is connected to the anode and the cathode. Metal is removed from the liquid by the method of circulating the liquid between the circulating tank and recovery tank. While the liquid is circulating, the source of electric current supplies a decreasing electric current to the anode and the cathode to collect the metal on the cathode.

2 Claims, 6 Drawing Figures

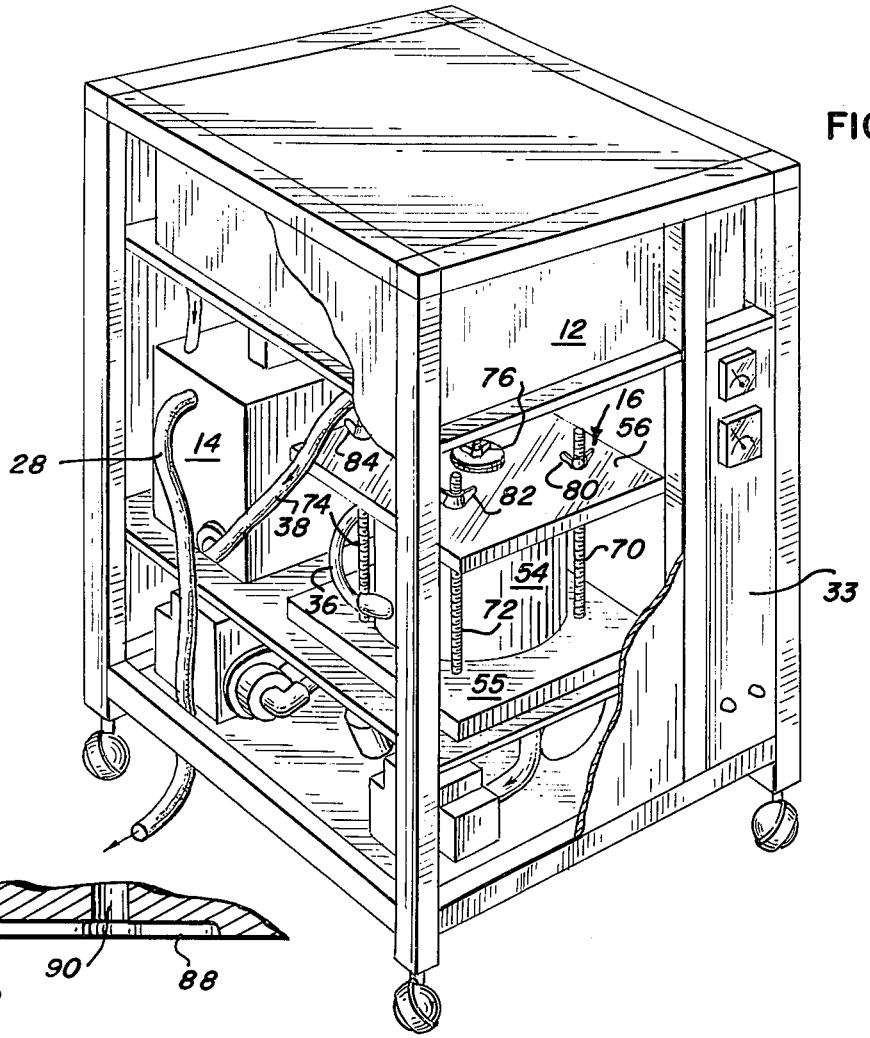
FIG. 1
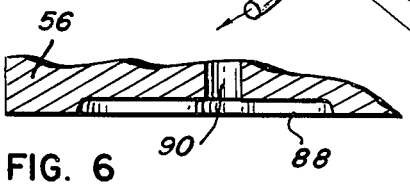
FIG. 6
FIG. 2
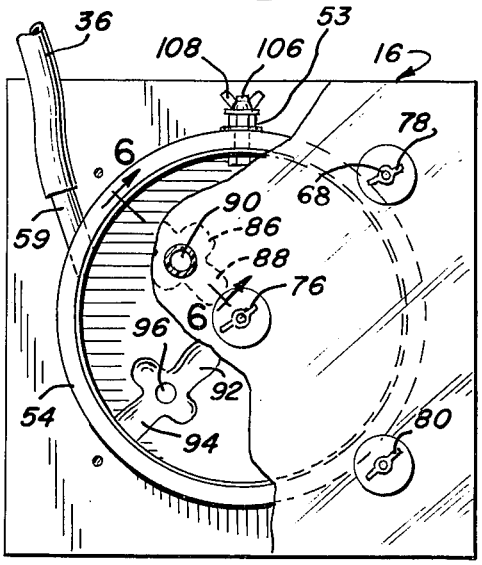
FIG. 3
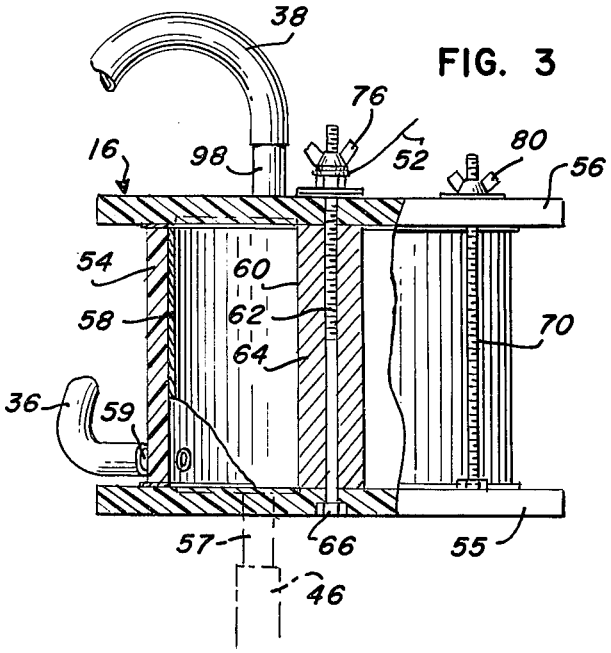

METHOD AND APPARATUS FOR RECOVERY OF METAL FROM LIQUID

BACKGROUND OF THE INVENTION

Photographic processes are being used to a great extent today. Typical of an industrial use is the large amount of X-ray film sold and processed each year. Essential to a photographic process is the use of silver compounds; and, in particular, silver halides. The silver compounds are dissolved throughout an emulsion, which is deposited upon a photographic film or plate. During development of the photographic film, silver is removed from unexposed or under-exposed areas of the film by the development process.

A developer, a stop bath, and a fixer acquire silver from the film as a result of the development process. When the developer, the stop bath or the fixer are exhausted, they are usually disposed of by pouring down a drain of a sink. Any silver dissolved in these photographic chemicals is, of course, also poured down the drain and wasted. Silver is becoming increasingly expensive; and large amounts of silver are used each year by the photographic industry.

In addition, heavy metals (such as silver) which are disposed of by pouring down a drain present a pollution hazard. The metals disposed of in this manner can be ingested by organisms and poison them.

Devices have been developed for removing silver from photographic chemicals. The devices previously developed cannot handle large amounts of liquid on a continuous basis. Furthermore, these devices often have a tendency to burn the photographic chemicals through the application of excessive electroplating currents.

What is needed is a device or method which is automatic; and should be able to quickly and conveniently remove the silver or other metals from the solution in which they are found and dispose of the exhausted solution after the metal has been removed. The device or method should be able to handle large amounts of liquid on a continuous basis; and should not burn the liquid being treated.

SUMMARY OF THE INVENTION

A metal recovery apparatus, which includes a receiving tank, is disclosed herein. A circulating tank is connected to the receiving tank by an overflow line and a fill line. A recovery tank is connected to the circulating tank by a feed line and a return line. The recovery tank has an anode and a cylindrical cathode positioned therein. A first drain pump is connected to the circulating tank; and a second drain pump is connected to the recovery tank. A circulating pump is connected to the feed line between the circulating tank and the recovery tank. A source of electric current is connected to the anode and the cathode.

Waste photo-chemical solution is received in the receiving tank. The waste photo-chemical solution flows from the receiving tank into the circulating tank through either the intake line or the overflow line. The photo-chemical solution is then circulated by the circulating pump from the circulating tank to the recovery tank; and back again through the feed line and the return line a number of times. A current, which decreases with time, is applied across the anode and the cathode to plate out silver, which is in solution with the waste photo-chemicals. After a predetermined time, during which most of the silver is removed from the photo-chemical solution by electroplating on the cathode, the drain pumps are switched on; and drain the circulating tank and the recovery tank, leaving the silver deposited on the cathode. The circulating tank and recovery tank are automatically refilled from the receiving tank; and the process is started once again on a new batch of waste photo-chemicals received from the receiving tank.

After a number of batches of photo-chemicals are thus processed, the recovery tank can be removed; and another recovery tank substituted in a matter of minutes to insure relatively uninterrupted use of the metal recovery apparatus. The cylindrical cathode of the first recovery tank can then be removed from the first recovery tank; and a new cylindrical cathode placed in the first recovery tank in a matter of minutes. Silver plated on the cylindrical cathode can be removed from the cathode by tapping it.

It is a principal object of the present invention to provide a metal recovery apparatus for removing a metal from a liquid which is automatic in its operation.

It is another object of the present invention to provide a metal recovery apparatus for removing a metal from a liquid by electroplating, which continuously circulates the liquid past an anode and a cathode.

It is a further object of the instant invention to provide a metal recovery apparatus for removing a metal from a liquid which is particularly adapted to remove silver from waste photo-chemical solution.

It is still another object of the instant invention to provide a metal recovery apparatus for recovering a metal from a liquid solution which may be placed in series connection with a drain pipe from a developing sink or tank to a drain pipe leading to a sewer connection.

Other objects and uses for the present invention will become obvious to one skilled in the art upon a perusal of the following specification and the accompanying drawings.

BRIEF DESCRIPTION OF THE DRAWINGS

FIG. 1 is a perspective view of a metal recovery apparatus embodying the present invention, having portions cut away to show details of a circulating tank and a recovery tank;

FIG. 2 is an enlarged top view of the recovery tank of FIG. 1, having portions cut away to show details of the inside construction of the recovery tank and the positioning of a feed line and nozzle;

FIG. 3 is an enlarged side elevational view of the plating tank of FIG. 2, having a portion cut away to show details of an anode, a cathode and a port construction of the recovery tank;

FIG. 6 is an enlarged cross-sectional view taken along Line 6—6 of FIG. 2, showing details of a bubble trap formed in the recovery tank.

DESCRIPTION OF THE PREFERRED EMBODIMENT

Figure 4:
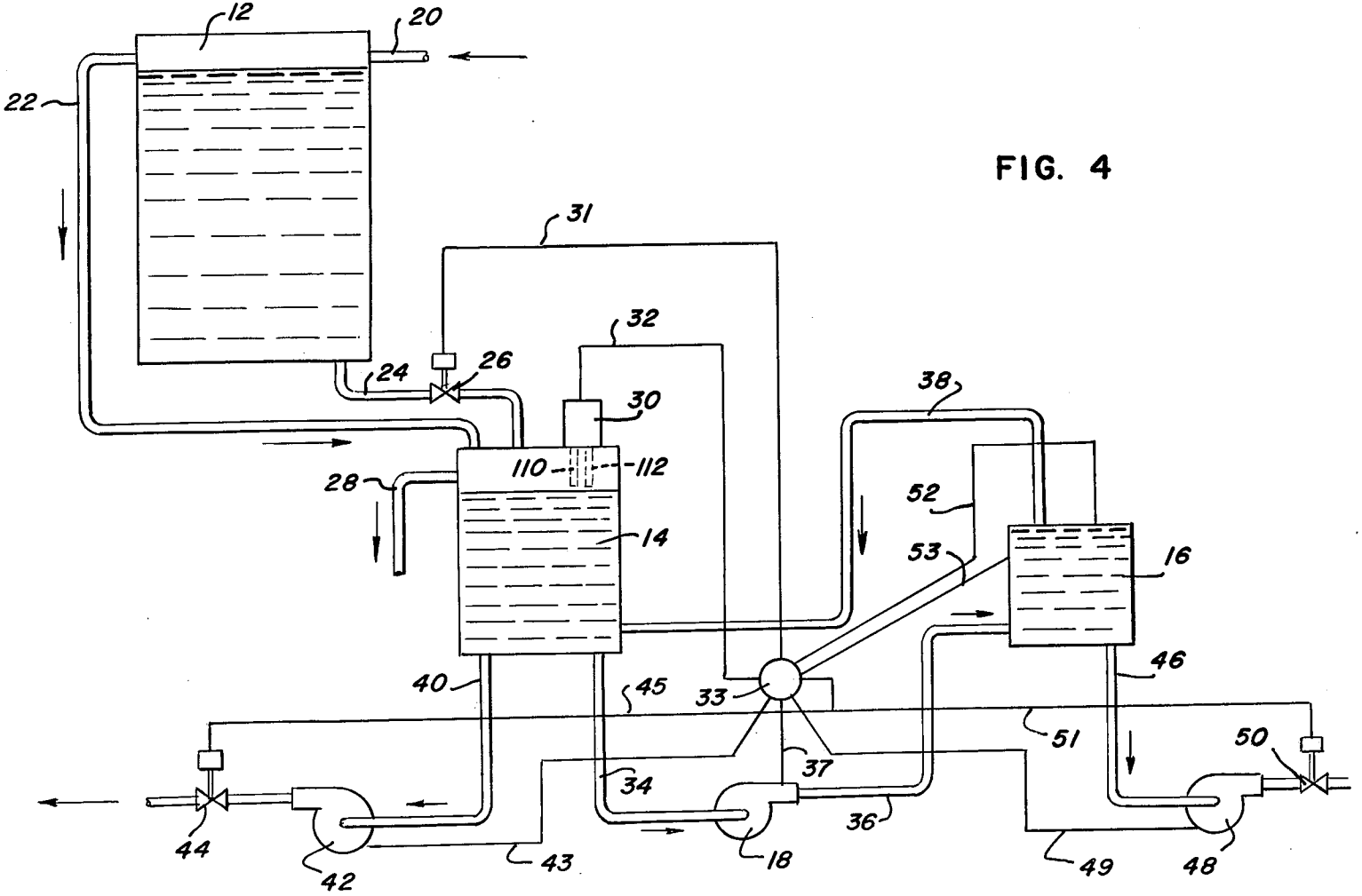
FIG. 4 is a schematic diagram of the metal recovery apparatus of FIG. 1, showing details of the interconnection of the various parts of the solution-handling portion of the metal recovery apparatus.

Referring now to the drawings, and especially to FIG. 4, a schematic diagram of a metal recovery apparatus 10 is generally shown therein. Metal recovery apparatus 10 includes a receiving tank 12. A circulating tank 14 is connected to receiving tank 12. Circulating tank 14 is positioned below receiving tank 12. A recovery tank 16 is connected in a loop to circulating tank 14. A circulating pump 18 is connected between circulating tank 14 and recovery tank 16.

An inlet line 20 is connected to an upper portion of receiving tank 12. An overflow line 22 is connected to receiving tank 12 at its upper portion. A feed line 24 is connected to a bottom portion of receiving tank 12.

Overflow line 22 is also connected to the upper portion of circulating tank 14. Feed line 24 is connected to an electrically-controlled receiving tank valve 26. Electrically-controlled receiving tank valve 26 is connected to circulating tank 14.

An overflow drain line 28 is connected to the upper portion of circulating tank 14. An electrical level sensor 30 is also connected to the upper portion of circulating tank 14. Electrically-controlled receiving tank valve 26 and level sensor 30 are, respectively, connected by a pair of leads 31 and 32 to an electrical control circuit 33. A feed line 34 is connected to a bottom portion of circulating tank 14. Feed line 34 is, in turn, connected to circulating pump 18. Circulating pump 18 is connected to a feed line 36. A lead 37 connects circulating pump 18 to electrical control circuit 33. A return line 38 is connected to the bottom portion of circulating tank 14. A drain line 40 is also connected to the bottom portion of circulating tank 14. Drain line 40 is connected to a drain pump 42. Drain pump 42 is connected by means of a lead 43 to electrical control circuit 33. An electrically-controlled drain valve 44 is connected to an outlet of drain pump 42. Electrically-controlled drain valve 44 is connected by means of a lead 46 to electrical control circuit 33.

Recovery tank 16 is connected to feed line 36. Recovery tank 16 is also connected at an upper portion tp return line 38. Recovery tank 16 has a drain line 46 connected to a bottom portion. A drain pump 48 is connected to drain line 46. Drain pump 48 is connected to electrical control circuit 33 by means of a lead 49. A drain valve 50, which is electrically operated, is connected to an outlet of drain pump 48. Drain valve 50 is connected to electrical control circuit 33 by means of a lead 51. A pair of leads 52 and 53 connects electrical control circuit 33 to recovery tank 16.

Referring now to FIGS. 2 and 3, details of the construction of recovery tank 16 are shown therein. Recovery tank 16 is less than one-half the volume of circulating tank 14. Recovery tank 16 is of a generally cylindrical construction, having a cylindrical wall 54; a square bottom 55; and a square top 56. A drain fitting 57 penetrates square bottom 55, perpendicular to square bottom 55. Drain line 46 is connected to drain fitting 57. An integral portion of cylindrical wall 54 is a stainless steel liner 58, which is fitted contiguous with the inside of cylindrical wall 54. Stainless steel liner 58 acts as a cathode. A non-metallic inlet fitting 59 penetrates cylindrical wall 54 to a conical opening in stainless steel liner 58. Inlet fitting 59 is positioned tangentially with respect to cylinder wall 54. Inlet fitting 59 is connected to feed line 36. A carbon rod 60 is centered within stainless steel liner 58. Carbon rod 60 has an internal threaded rod 62, and a cylindrical jacket 64. Cylindrical jacket 64 is composed of fine-grain pure carbon graphite, sealed with a phenolic resin. Threaded rod 62 is threadedly connected to a nut 66, which is embedded in square bottom 55. A plurality of threaded rods (respectively numbered 68, 70, 72 and 74) is perpendicularly connected to square bottom 55; and penetrates square top 56. A plurality of wing nuts (numbered 76, 78, 80, 82 and 84) is respectively threadedly connected to threaded rods 62, 68, 70, 72 and 74. A cruciform bubble trap 86, having a recessed portion 88 and a conduit portion 90, is formed in square top 56. A cruciform drain 92, having a recessed portion 94 and a conduit portion 96, is formed in square bottom 55. An outlet fitting 98 perpendicularly penetrates square top 56; and is connected to conduit portion 90. Drain fitting 57 is connected to conduit portion 96. Outlet fitting 98 is connected to return line 38.

Anode 60 is connected to electrical control circuit 33 through lead 52, which is attached to threaded rod 62 and wing nut 78. Likewise, cathode 58 is attached to lead 53 through a bolt 106 and a wing nut 108. Bolt 106 and wing nut 108 are radially connected to stainless steel liner 58.

Figure 5:
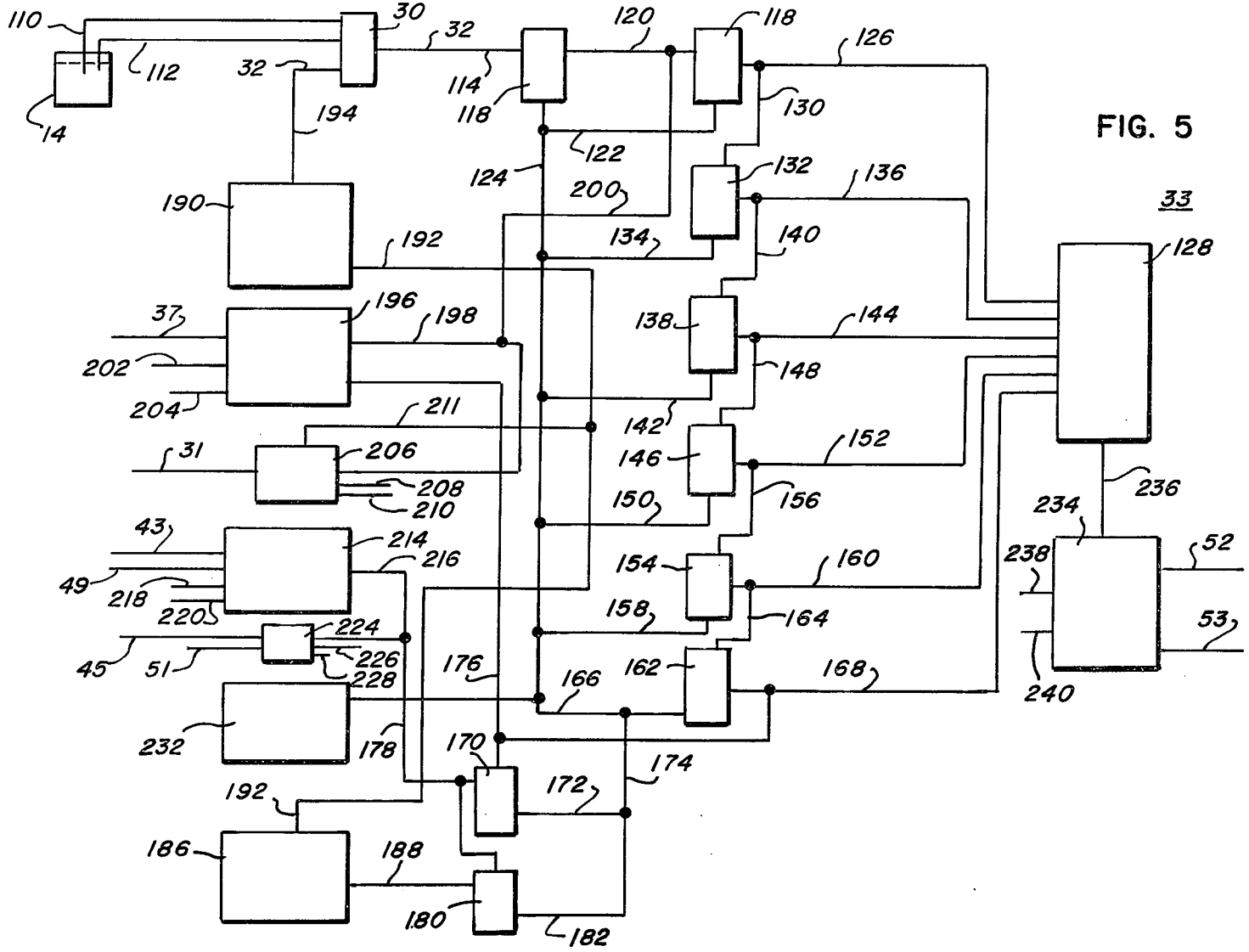
FIG. 5 is a schematic diagram of the electrical circuitry of the metal recovery apparatus of FIG. 1.

Referring now to FIG. 5, level sensor 30 (which is also a start-cycle sensor) has a pair of probes 110 and 112 positioned near the top of circulating tank 14. Start-cycle sensor 30 is connected by an output lead 114 to a recovery tank-filling timer 116.

Recovery tank-filling timer 116 is connected to a first current timer 118 by an output lead 120. A reset lead 122 connects first current timer 118 to a main reset line 124, which is connected to recovery tank-filling timer 116. First current timer 118 is connected by an output lead 126 to a current decoder 128. Output lead 126 is also connected to a trigger lead 130.

Trigger lead 130 is an input lead, which is connected to a second current timer 132. Second current timer 132 is connected to main reset line 124 by a reset lead 134. Second current timer 132 is connected to current decoder 128 by an output lead 136.

A third current timer 138 is connected to output line 136 by a trigger lead 140. A reset lead 142 connects main reset line 124 to third current timer 138. Third current timer 138 is connected to current decoder 128 by an output lead 144.

A fourth current timer 146 is connected by a trigger lead 148 to output lead 144. Fourth current timer 146 is connected to main reset line 124 by a reset lead 150. Fourth current timer 146 is connected to current decoder 128 by an output lead 152.

A fifth current timer 154 is connected by a trigger lead 156 to output lead 152. Fifth current timer 154 is connected to main reset line 124 by a reset lead 158. Fifth current timer 154 is connected to current decoder 128 by an output lead 160.

A sixth current timer 162 is connected by a trigger lead 164 to output lead 160. Sixth current timer 162 is connected to main reset line 124 by a reset lead 166. Sixth current timer 162 is connected to current decoder 128 by an output lead 168.

A drain cycle timer 170 is connected by a reset lead 172 to a branch lead 174. Branch lead 174 is connected to reset lead 166. A trigger lead 176 is also connected to drain cycle timer 170. An output lead 178 is connected to drain cycle timer 170.

An end-of-cycle timer 180 is connected by a reset lead 182 to branch lead 174. A trigger lead 184 is connected to output lead 178 of drain cycle timer 170. An end-of-cycle circuit 186 is connected to end-of-cycle timer 180 by an output lead 188. End-of-cycle reset circuit 186 is connected to a false entry interlock circuit 190 by an output lead 192. False entry interlock circuit 190 is connected to level sensor 30 by a lead 194.

A circulating pump control circuit 196 is connected by stop lead 176 to drain cycle timer 170. Circulating pump control circuit 196 has a start pump input lead 198 connected to a lead 200. Circulating pump control circuit 196 has a pair of 115-volt A.C. input terminals 202 and 204. Circulating pump control circuit 196 is connected by output lead 37 to circulating pump 18.

Lead 200 is connected to a receiving tank valve control circuit 206 and timer 116. Receiving tank valve control circuit 206 has a pair of 24-volt A.C. input terminals 208 and 210. Receiving tank valve control circuit 206 has an input lead 211, which is connected to lead 192 of end-of-cycle reset circuit 186. Valve control circuit 206 is connected by output lead 31 to receiving tank valve 26.

A drain pump control circuit 214 is connected by an input lead 216 to lead 178 of drain cycle timer 170. Drain pump control circuit 214 has a pair of power leads 218 and 220. Leads 218 and 220 are connected to a suitable source of 115-volt A.C. electrical power. Drain pumps 42 and 48 are, respectively, connected to drain pump control circuit 214 by leads 42 and 49.

A drain valve control circuit 224 is connected to lead 178. Drain valve control circuit 224 has a pair of input leads 226 and 228, which are connected to a source of electrical energy supplying 24-volt A.C. current. Drain valves 44 and 50 are, respectively, connected to drain valve control circuit 224 by leads 45 and 51.

A power-up reset circuit 232 is connected to line 124.

A current driver circuit 234 is connected to current decoder 128 by a lead 236. A pair of input terminals 238 and 240 are connected to a suitable source of 115-volt A.C. power. Anode 60 and cathode 58 are, respectively, connected to current driver circuit 234 by leads 52 and 53.

A waste photo-chemical solution, which is to be processed, flows into inlet line 20 of receiving tank 12. Receiving tank 12 fills with photo-chemical solution. The solution is periodically released by receiving tank valve 26 to flow downward through feed line 24 into circulating tank 14. An excess of solution flows through overflow line 22 to circulating tank 14, where it either fills circulating tank 14 or leaves apparatus 10 through overflow drain line 28.

When the liquid level in circulating tank 14 reaches the height of probes 110 and 112, and a signal is supplied on lead 194 by false entry interlock circuit 190, start cycle sensor 30 starts recovery tank-filling timer 116. Recovery tank-filling timer 116 causes the receiving tank valve control circuit 206 to close receiving tank valve 26. At the same time, circulating pump control circuit 196 starts circulating pump 18. Circulating pump 18 circulates the liquid between circulating tank 14 and recovery tank 16. Circulating pump 18 and receiving tank valve 26 continue in the pumping and closed states, respectively, until a stop pump signal is received through lead 176.

First current timer 118 is then started about 30 seconds after the circulating pump 18 starts pumping. First current timer 118 supplies a signal for 15 minutes to current decoder 128. Current decoder 128, in turn, causes current driver 234 to supply a 25-ampere direct current to recovery tank 16 at anode 60 and cathode 58 for 15 minutes. Silver is then electroplated on cathode 58 from the liquid by the 25-ampere direct current.

First current timer 118 causes the first of a decreasing series of direct currents to be applied to anode 60 and cathode 58. The current is decreased, with time to prevent burning of the liquid as the silver is removed.

After 15 minutes are up, first current timer 118 times out; and triggers second current timer 132 to start. Second current timer 132 also runs for 15 minutes; and produces a 15-minute signal at lead 136. Current decoder 128 then causes current driver 234 to supply an 18-ampere direct current to recovery tank 16 for 15 minutes. After 15 minutes are up, second current timer 132 times out; and a signal is supplied at lead 140 to cause third current timer 138 to begin timing.

Third current timer 138 supplies a signal to lead 144 for 5 minutes. Current decoder 128 causes current driver 234 to supply a 16-ampere direct current to anode 60 and cathode 58 of recovery tank 16 for 5 minutes. Third current timer 138 then times out; and, in a similar fashion, switches on fourth current timer 146 through a signal sent through lead 148.

Fourth current timer 146 then supplies a 5-minute time signal through output lead 152 to current decoder 128. Current decoder 128 causes current driver 234 to supply an 8-ampere direct current for 5 minutes to anode 60 and cathode 58 in recovery tank 16. When fourth current timer 146 times out after 5 minutes, fifth current timer 154 is triggered through a signal which passes through trigger lead 156.

The fifth current timer 160 supplies a 5-minute time signal at lead 160. Thus, current decoder 128 causes current driver 234 to supply a 4-ampere direct current to recovery tank 16 for 5 minutes. After 5 minutes are up, fifth current timer 154 times out; and switches sixth current timer 162 on.

Sixth current timer 162 produces a 5-minute signal, which is transmitted to current decoder 128 through lead 168. Current decoder 128 then causes current driver 234 to supply a 2-ampere direct current to anode 60 and cathode 58 of recovery tank 16 for 5 minutes.

After 5 minutes, sixth current timer 162 times out; and causes drain cycle timer 170 to start timing. After sixth current timer 162 times out, current decoder 128 is no longer being supplied with a signal from one of the current timers; and, therefore, current driver 234 is not supplying any electric current to anode 60 and cathode 58. Therefore, after sixth current timer 162 times out, the electroplating portion of the processing cycle is over.

Drain cycle timer 170 supplies a stop pump signal for a selected period of time to circulating pump control circuit 196, thereby causing circulating pump 18 to stop. Also, a signal is supplied to drain pump control circuit 214 and drain valve control circuit 224 by drain cycle timer 170 to cause drain pumps 42 and 48 to begin pumping and to simultaneously open drain valves 44 and 46, thereby draining circulating tank 14 and recovery tank 16.

After drain cycle timer 170 times out, end-of-cycle reset timer 180 thereby begins running and causing a reset pulse to be supplied to false entry interlock circuit 190. The reset pulse causes receiving tank valve control circuit 206 to supply a momentary 24-volt pulse to valve 26, thereby opening valve 26. Circulating tank 14 and recovery tank 16 are thus gravity-filled with new solution. The reset pulse is supplied to false entry interlock circuit 190 for a period of time until liquid level detector 30 once again senses that circulating tank 14 has been filled. Thus, the processing cycle begins again. The cycle will continue to repeat itself automatically as long as a supply of solution is present in the receiving tank 12 in sufficient quantities to fill circulating tank 14 and recovery tank 16.

While the current is being applied to the anode and the cathode, bubbles may form in the liquid. The gas bubbles rise to square top 56 of recovery tank 16, where they become entrapped in bubble trap 86. The gas bubbles then flow through return line 38 to circulating tank 14. Circulating tank 14 is filled with liquid above the level of square top 56 of recovery tank 16.

After a number of cycles, the plated silver is ready to be removed. Recovery tank 16 is disconnected by slipping feed line 36 off inlet 59; by slipping return line 38 off outlet 98; by slipping drain line 46 off fitting 57; and by disconnecting leads 52 and 53. A second recovery tank can then be connected to the apparatus within a few minutes by reconnecting feed line 36, return line 38, drain line 46, lead 52 and lead 53 to the second recovery tank, thus allowing only a minimal interference with operation.

After the second recovery tank is thus connected, the silver can then be removed from recovery tank 16. Wing nuts 76, 78, 80, 82 and 84 are disconnected from threaded rods 62, 68, 70, 72 and 74, respectively. Bolt 106 and wing nut 108 are removed from cathode 58. Top 56 is then lifted off rods 62, 68, 70, 72 and 74. Cylindrical wall 54 is then tapped lightly to remove the silver. The silver flakes off stainless steel liner 58; and recovery tank 16 is once again ready for use. The silver may then be resold or otherwise used.

Recovery tank 16 can then be reassembled by placing top 56 back on cylindrical wall 54. Wing nuts 76, 78, 80, 82 and 84 are reconnected to threaded rods 62, 68, 70, 72 and 74, respectively. When the second recovery tank is removed, recovery tank 16 can then be replaced in metal recovery apparatus 10.

It may be appreciated that the herein-disclosed invention provides continuous and convenient removal of metal from liquids.

It may also be appreciated that the combination of circulating the liquid and stepping down the current allows rapid recovery of metal from the liquid without burning the liquid.

Although a specific embodiment of the instant invention has been set forth and described in detail above, it is readily apparent that those skilled in the art may make various modifications and changes in the present invention without departing from the spirit and scope thereof. The instant invention is limited only by the appended claims.

What is claimed is:

1. A metal recovery apparatus for recovering a metal carried in a liquid comprising: a receiving tank having an overflow line connected to an upper portion thereof, said receiving tank having a receiving tank feed line connected to a lower portion thereof; a tank connected to said overflow line and said receiving tank feed line, said overflow line being adapted to receive overflow of said liquid from said receiving tank and channel said overflow of said liquid to said second mentioned tank, said receiving tank feed line being adapted to channel said liquid from said receiving tank to said second mentioned tank; a closed recovery tank connected to said second mentioned tank; an anode supported in said closed recovery tank; a cathode supported in said closed recovery tank; a timer connected to said anode and said cathode, said timer controlling a time during which a current is applied to said anode and said cathode to collect said metal on said cathode; and a pump connected between said second mentioned tank and said closed recovery tank, said pump being adapted to circulate all of said liquid carrying said metal between said second mentioned tank and said closed recovery tank.

2. A metal recovery apparatus for recovering a metal from a liquid comprising: a receiving tank, said receiving tank having an upper portion and a lower portion, an overflow line connected to said upper portion of said receiving tank, a first feed line connected to said lower portion of said receiving tank; a valve connected to said first feed line, said valve being adapted to control liquid flow through said first feed line; a circulating tank connected to said valve, said circulating tank being positioned below said receiving tank, said circulating tank being fillable to a selected height, a second feed line connected to said circulating tank; a circulating pump connected to said second feed line to drive all of said liquid through said second feed line; a return line connected to said circulating tank, said return line being adapted to return all of said liquid to said circulating tank; a closed recovery tank connected to said second feed line and said return line, said closed recovery tank having a top portion and a bottom portion, said closed recovery tank having an inlet in said bottom portion, said inlet being connected to said second feed line, said closed recovery tank having an outlet in said top portion, said outlet being connected to said return line, said outlet being positioned below said selected height of said circulating tank, said closed recovery tank having a carbon anode and a stainless steel cathode positioned therein, said carbon anode and said stainless steel cathode being connected to a timer circuit, said timer circuit being adapted to supply an incrementally decreasing electrical current to said carbon anode and said stainless steel cathode, said stainless steel cathode being adapted to receive electrolytically said metal from said liquid; a first drain pump connected to said closed recovery tank being adapted to drain said recovery tank; and a second drain pump connected to said circulating tank to drain said circulating tank.

* * * * *